US007469694B2

(12) United States Patent
Howard et al.

(10) Patent No.: US 7,469,694 B2
(45) Date of Patent: Dec. 30, 2008

(54) HEIGHT MECHANISM FOR EQUIPMENT, INCLUDING CONCRETE SAWS

(75) Inventors: David R. Howard, Olathe, KS (US); Richard M. Tremain, Lake Tapawingo, MO (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 500 days.

(21) Appl. No.: 10/357,309

(22) Filed: Feb. 3, 2003

(65) Prior Publication Data

US 2004/0159315 A1 Aug. 19, 2004

(51) Int. Cl.
*B28D 1/04* (2006.01)
*B24B 23/00* (2006.01)

(52) U.S. Cl. ..... 125/13.01; 451/352

(58) Field of Classification Search ..... 125/13.01, 125/14; 451/352; 299/39.3, 39.6
See application file for complete search history.

(56) References Cited

U.S. PATENT DOCUMENTS 2,031,665 A * 2/1936 Myers ..... 451/352
2,468,336 A * 4/1949 Lewis ..... 299/39.3
2,935,981 A * 5/1960 Middlestadt ..... 125/14
3,301,601 A * 1/1967 Zuzelo ..... 451/352
3,357,745 A * 12/1967 Cooper ..... 299/39.3
3,663,060 A * 5/1972 Shatwell et al. ..... 299/39.3
4,953,523 A * 9/1990 Swan ..... 125/14
5,167,215 A 12/1992 Harding, Jr.
5,241,946 A 9/1993 Yelton et al.
5,950,612 A 9/1999 Zuzelo et al.
6,484,711 B2 11/2002 Acker et al.
6,536,422 B1 * 3/2003 Zuzelo et al. ..... 125/13.01
6,637,423 B1 * 10/2003 Rettenweber et al. .... 125/13.01
2007/0131211 A1 6/2007 Howard et al.

OTHER PUBLICATIONS

Federal-Mongul Corporation; Target®; "Mini/Consaw"; Operating Instructions and Parts List; Feb. 1986; pp. 1-3.
Diamant Boart Inc.; Target®; "Mini Con II Concrete Saw"; Operating Instructions and Parts List, May 1995; pp. 1, 3-15.

* cited by examiner

*Primary Examiner*—Hadi Shakeri
(74) *Attorney, Agent, or Firm*—Henricks, Slavin & Holmes LLP

(57) ABSTRACT

A portable saw has a depth or blade lowering control and an adjustable stop for selecting the maximum depth of the blade to which the blade can be lowered.

32 Claims, 6 Drawing Sheets

HEIGHT MECHANISM FOR EQUIPMENT, INCLUDING CONCRETE SAWS

BACKGROUND OF THE INVENTIONS

1. Field of the Invention

This disclosure relates to apparatus for processing or operating on a work piece, pavement or other material, including portable saws and other cutting or abrading devices.

2. Related Art

Some saws, for example light-weight portable concrete saws, have manually operated apparatus for moving the saw blade into and out of engagement with a work piece, for example a concrete slab, ceramic tile or other material on which the saw is to operate. The saw also includes a chassis with wheels for moving along the concrete surface and a frame supporting the saw blade that moves up and down relative to the chassis, and therefore relative to the concrete. The saw blade is moved into engagement with the concrete by raising or lowering a handle on the frame in such a way that the saw blade approaches and then engages the concrete. As the blade cuts in the concrete, the frame and the blade get closer to the concrete. The blade continues cutting deeper into the concrete until the frame reaches a stop. For example, a jack screw or other depth-limiting device at the front of the frame may move with the frame until the lower end of the jack screw touches the concrete surface. Alternatively, the lower end of the jack screw may come into contact with the chassis, at which point the frame and the saw blade stop their downward movement. The actual depth of cut is determined by the amount the jack screw is threaded through the frame closer to or further from the chassis.

SUMMARY OF THE INVENTIONS

Methods and apparatus are described which improve the operation and use of apparatus used for processing work pieces, including saws, concrete saws, portable concrete cutting devices and other cutting and abrading apparatus. For example, methods end apparatus are disclosed that can make easier the selection of blade depth for a saw, even while the user stands in the same position from which the saw is operated. Methods and apparatus are also disclosed that allow the saw to be raised and lowered, moved and repositioned for cutting to the same depth without re-adjusting the desired depth of cut. The saw can be repositioned and cut to the same depth without having to re-adjust the depth of cut. Methods and apparatus are also described that allow a wide range of selections for the depth of cut within the range established for the saw. Similarly, apparatus are described that allow the saw to be locked in a raised position, for example for transport. These and other features relating to such equipment will become evident.

In one example of methods and apparatus for processing work pieces, a frame with a drive mechanism is linked to a chassis movable relative to the frame. A control assembly on the frame has a frame height control and also a frame height stop. The frame height control in the context of a concrete saw, for example, can be used to bring the saw blade into and out of engagement with the concrete. The frame height stop can be used to set the depth of cut to be achieved by the saw blade. The apparatus may include a linkage between the frame and the chassis through which the frame height control can be used to raise and lower the frame, and thereby the saw blade, relative to the concrete. In one form, the apparatus includes a post, column, tree or other structure to put the control assembly within reach of an operator.

In another example, a frame and chassis are linked relative to each other to allow the frame to move relative to the chassis, and a control assembly on the frame includes a lever for positioning a saw blade relative to a work piece, for example a concrete slab. The lever may pivot on an axis, for example through a portion of the frame, and movement of the lever forward may move the saw blade closer to the concrete and movement of the lever backward may move the saw blade further from the concrete. The lever may be part of an assembly that includes an over center mechanism, for example configured in such a way that the saw blade is locked in an up position when the lever is moved fully backward. A frame height stop may be included so as to selectively stop the forward movement of the lever, effectively limiting the downward movement of the saw blade.

In a further example, a first frame and a second frame are linked relative to each other to allow the first frame to move relative to the second frame, and the first frame includes a control assembly for controlling the extent to which the first frame moves closer to the second frame. The control assembly includes a first frame position stop for stopping movement of the first frame toward the second frame when the spacing between the two reaches a predetermined magnitude. The control assembly also includes an actuator for moving the first and second frame members relative to each other. In one example, the first frame position stop and the actuator are movable in the same form of motion. For example, the actuator is movable through an arc and the first frame position stop is movable through an arc. Another example of the same form of motion has them both moving linearly. In another example, the position stop takes the form of a disk, and the disk can have a releasable lock element for fixing the disk in place, and a stop surface for stopping the movement of the actuator after the actuator has moved a desired amount. The disk may also have an indicator and/or graduations representing a desired depth of cut for a saw.

These and other examples will be considered further in conjunction with the drawings, a brief description of which follows, and the detailed description herein.

DETAILED DESCRIPTION

The following specification taken in conjunction with the drawings sets forth the preferred embodiments of the present inventions in such a manner that any person skilled in the art can make and use the inventions. The embodiments of the inventions disclosed herein are the best modes contemplated by the inventor for carrying out the inventions in a commercial environment, although it should be understood that various modifications can be accomplished within the parameters of the present inventions.

Methods and apparatus are described that improve the operation and use of equipment for processing work pieces. The examples described are concrete saws often used for cutting concrete, masonry, ceramic tile and other materials. While one or more parts of the examples described can also be used in other equipment, they will be described in the context of a lightweight portable saw, such as is commonly used for patch cutting, trench cutting and similar projects. However, it should be understood that they are similarly applicable to other methods and apparatus.

Figure 1:
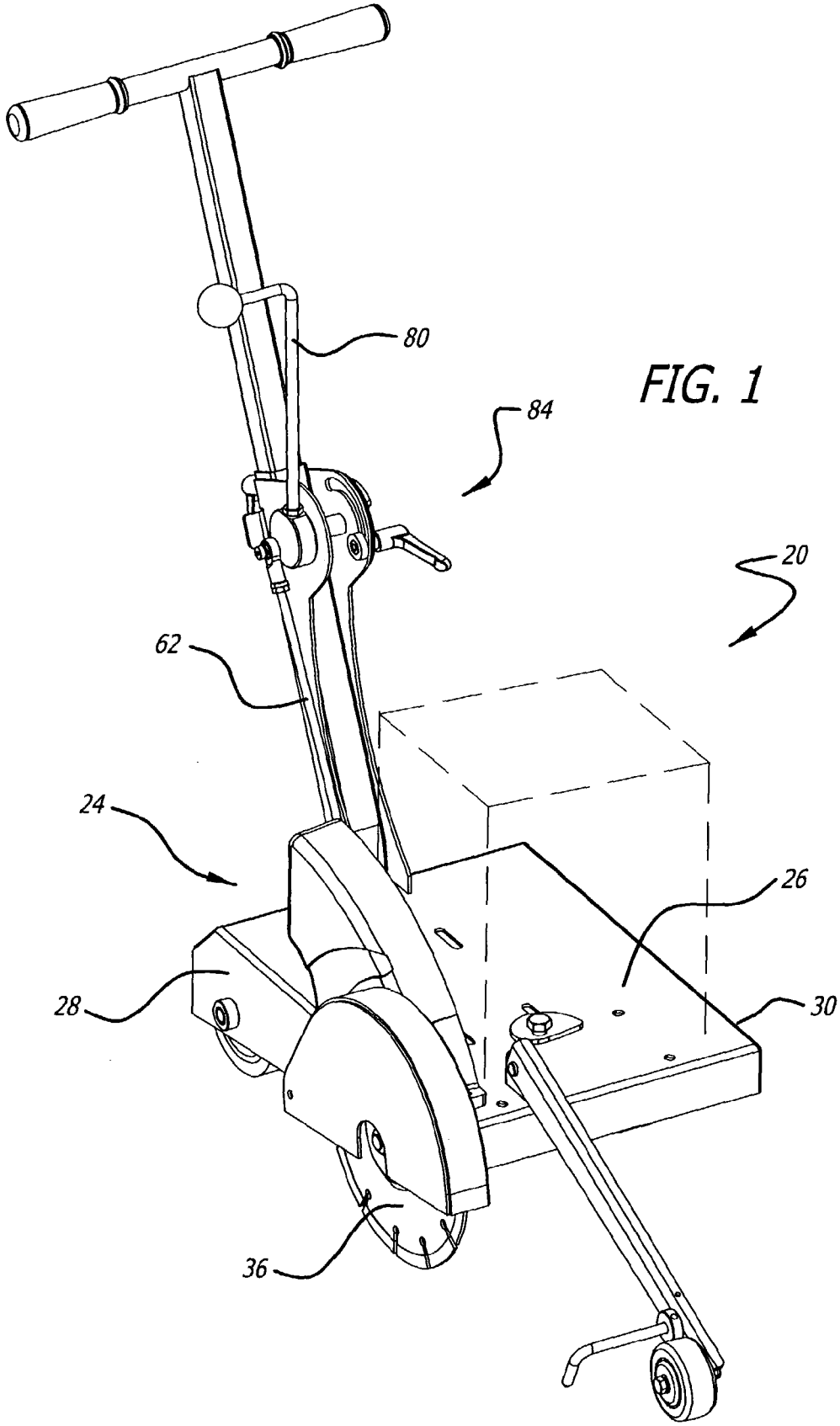
FIG. 1 is an upper right isometric view of a saw having features of the present inventions.
Figure 2:
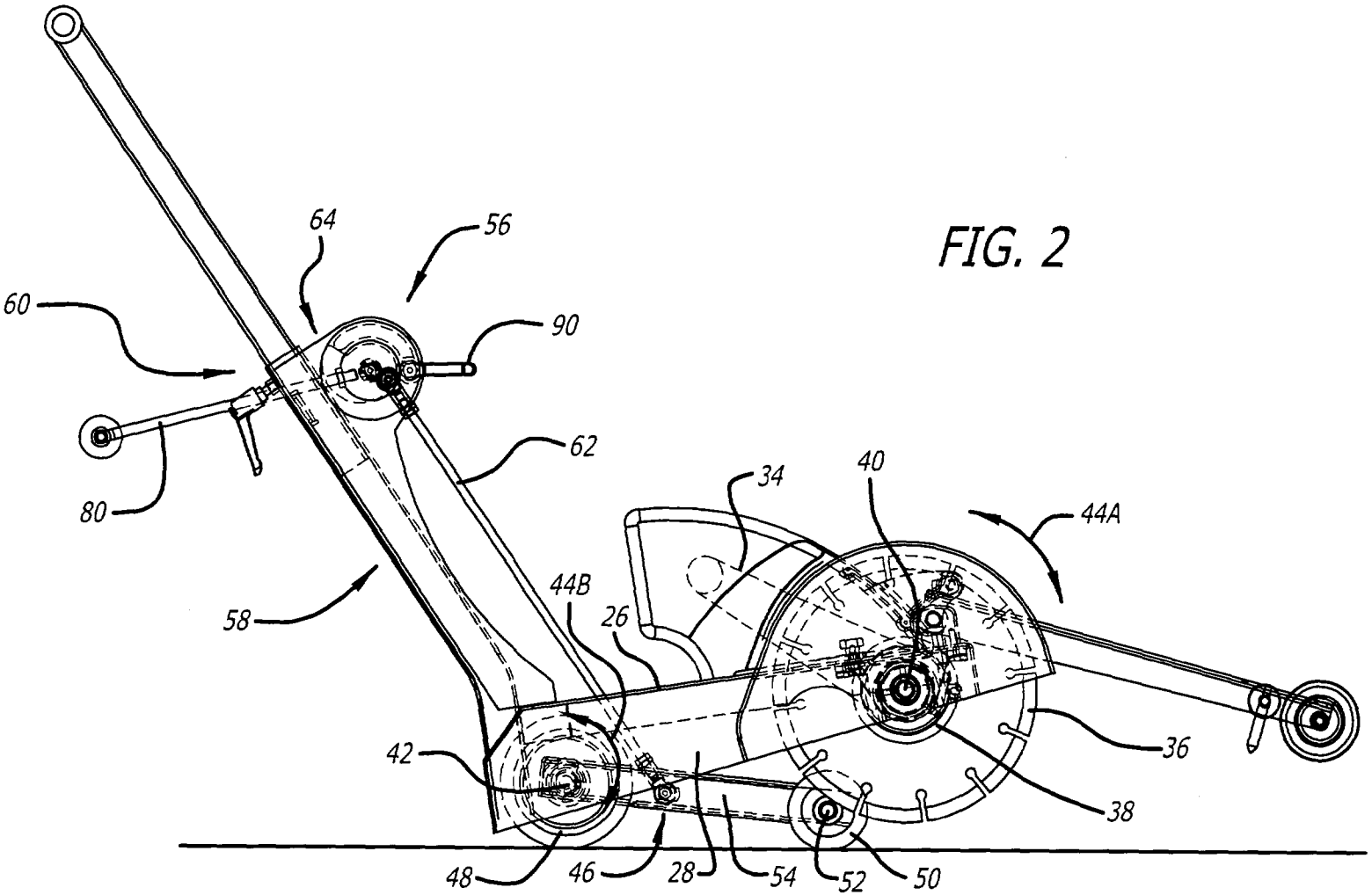
FIG. 2 is a right side elevation view of the saw FIG. 1.

A concrete saw 20 (FIGS. 1 & 2) can take any number of configurations, but as shown in FIGS. 1 and 2, the saw cuts a concrete slab 22. The saw includes a frame 24 having a platform 26 extending from a right frame member 28 to a left frame member 30. The platform 26 supports a drive mechanism such as a motor 32 and a drive belt 34. The drive belt 34 drives a saw blade 36 mounted on and supported by a blade flange 38. The drive belt 34 extends around a shiv mounted on a drive shaft represented at 40 supported on suitable bearings (not shown) in the frame 24.

The frame 24 includes an axle 42 (FIGS. 1 & 2) defining a pivot axis about which the frame 24 including the saw blade 36 can pivot. In the view shown in FIG. 2, pivoting the frame 24 counter clockwise about the pivot axis 42 raises the saw blade 36 from the concrete 22, while pivoting the frame clockwise about the axis 42 moves the saw blade closer to and into contact with the concrete. (See the arrows 44A and 44B.)

The frame is supported on the ground or on the concrete by a second frame or chassis 46. The frame and chassis are linked or coupled through the axle 42, allowing the frame to pivot relative to the chassis 46. The chassis 46 is supported by the concrete and remains flat relative to the concrete as the frame 24 pivots clockwise and counter clockwise about the axle 42. The chassis 46 is supported on the concrete by a pair of rear wheels 48, which are also supported for rotation by the axis 42, and a pair of front wheels 50 supported on a front axle 52. The wheels preferably have flat surfaces allowing the saw to move along the surface of the concrete. The axles 42 and 52 are supported by a suitable housing, a right chassis side 54 of which is shown in FIG. 2.

The saw includes a control assembly 56 (FIGS. 1 & 2) supported, in this example, by a column 58 extending upwardly and rearwardly from the back of the frame to an upper end 60. A handle stem is placed and extends into the upper end 60 of the column, and is secured in the column by a clamp or other securement device so that the handle can be positioned approximately waist high. The upper end 60 preferably terminates at a point that is within reach for most users. The control assembly 56 includes several manually accessible components that are in the area of the upper end 60 so that they are easily accessible to the user without needing extraordinary effort.

In the example shown in the drawings, the control assembly 56 (FIGS. 1-4) includes a coupling in the form of a tie rod 62 extending between the control assembly 56 and the chassis 46 so that changing the configuration of the control assembly 56 on the frame 24 changes the position of the frame relative to the chassis 46. The tie rod 62 is preferably coupled to the chassis in such a way as to allow the desired movement between the tie rod and the chassis, and may be coupled to the chassis through a rod end bearing, such as an IGUBA bearing available from IGUS, Inc., to a weld nut. The tie rod can be coupled to the chassis at any of a number of locations. In the example shown in FIG. 2, the tie rod is coupled to the right chassis side 54. Alternatively, the tie rod can be coupled at the front axle 52, at the left chassis side, or at other locations allowing movement of the tie rod to change the positions of the frame and the chassis relative to each other, and therefore to change the position of the frame relative to the concrete.

The control assembly 56 includes a first frame height control 64 and a second frame height control 66. In the example illustrated, the first frame height control 64 adjusts the frame height and therefore the blade height relative to the concrete within any point in the full possible range of movement of the frame 24 relative to the chassis 46 and the ground 22. The second frame height control 66 adjusts one end of the range of movement from the end of the range of movement to a point allowing less than the full range of movement. The second frame height control 66 sets the blade depth for cutting, and it is adjustable to allow different settings for the depth of cut. In the illustrated example, both of the first and second frame height controls are within easy reach, and are easily adjusted.

Figure 7:
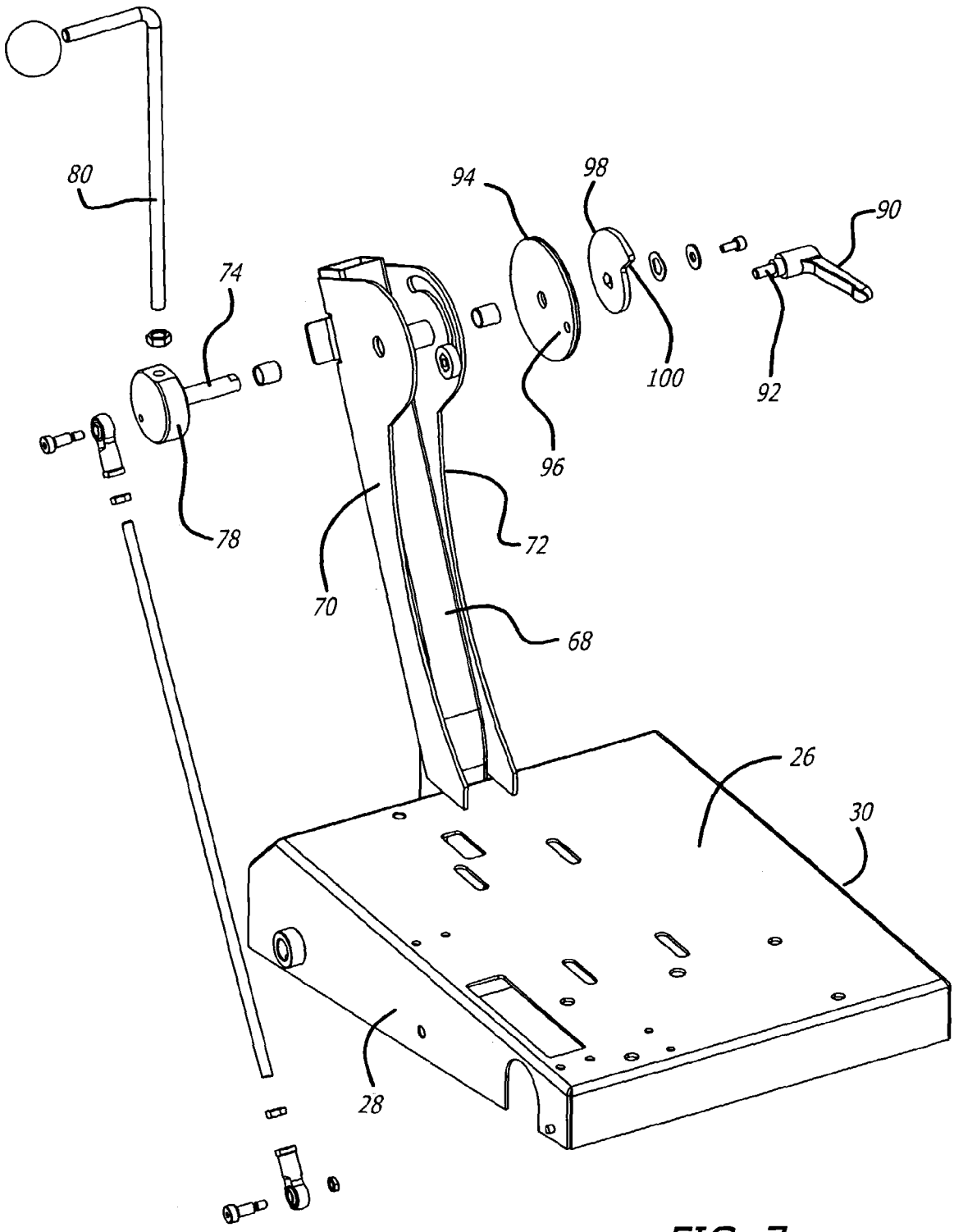
FIG. 7 is an exploded view of the control assembly of FIG. 4.

In the example shown in FIGS. 1 and 2, the column 58 supporting the control assembly is formed from a rectangular tube 68 which is bracketed on the sides by a right support plate 70 and a left support plate 72. The first frame height control 64 is supported outside the right plate 70 on a depth control shaft 74 (FIG. 7) extending through both of the right and left plates 70 and 72, respectively. The first frame height control 64 is preferably configured to be an over-center mechanism, so that when the blade is moved to its raised position, it remains there until the first frame height control is manually moved.

Considering the first frame height control 64 in more detail (FIG. 4), the control 64 includes a transfer disk 76 centered on and mounted to the depth control shaft 74 and pivotable with the shaft 74 so that the perimeter 78 of the transfer disk can move through an arc. The tie rod 62 is mounted to a perimeter portion of the transfer disk. Rotation of the transfer disk therefore moves the tie rod on one side or the other of the depth control shaft 74, so that in the process, the tie rod bears against the chassis to move the frame further from the chassis, or draws the chassis closer so that frame moves closer to the chassis.

Figure 4:
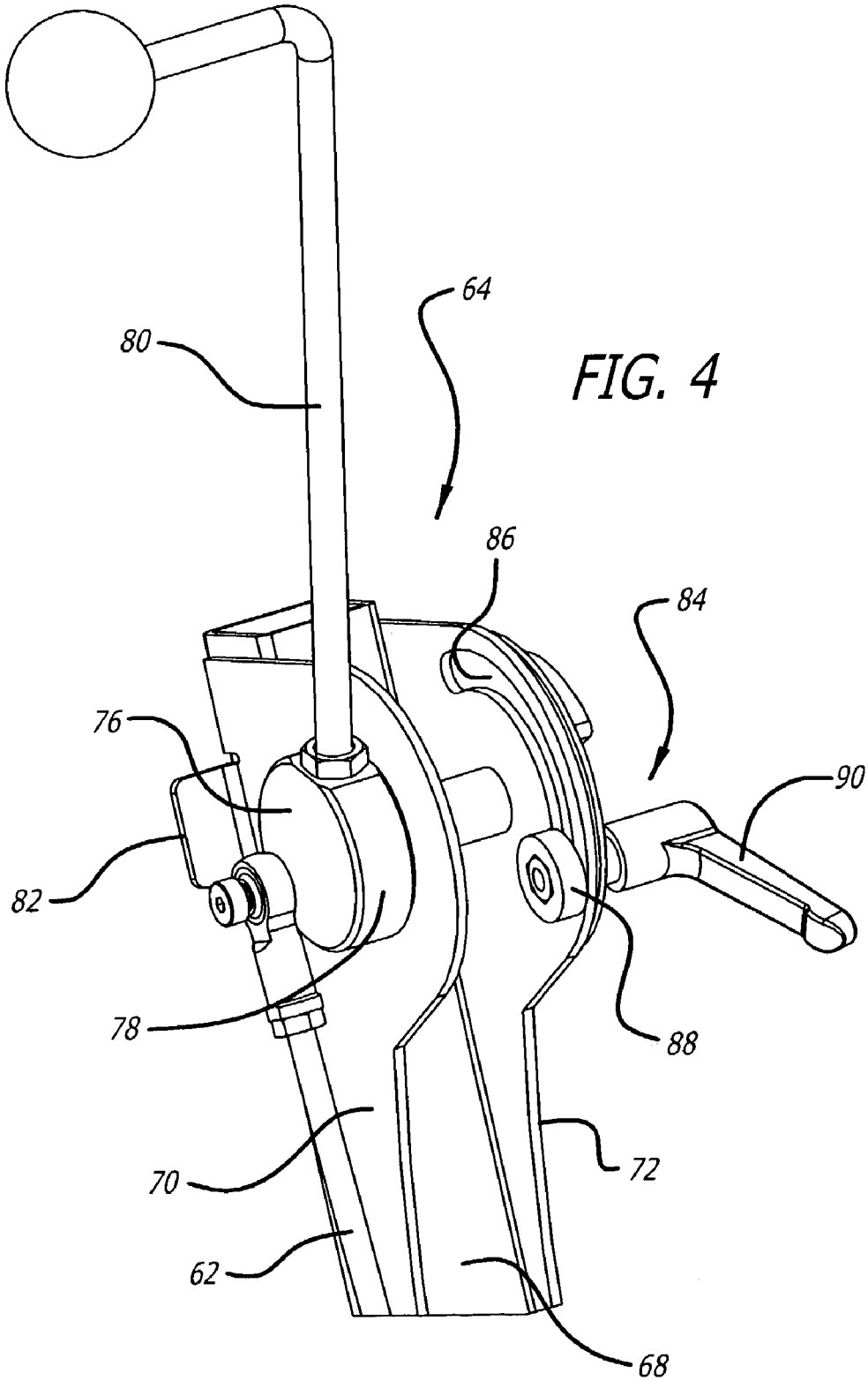
FIG. 4 is an isometric detail of a blade height control assembly on the saw of FIG. 1.
Figure 6:
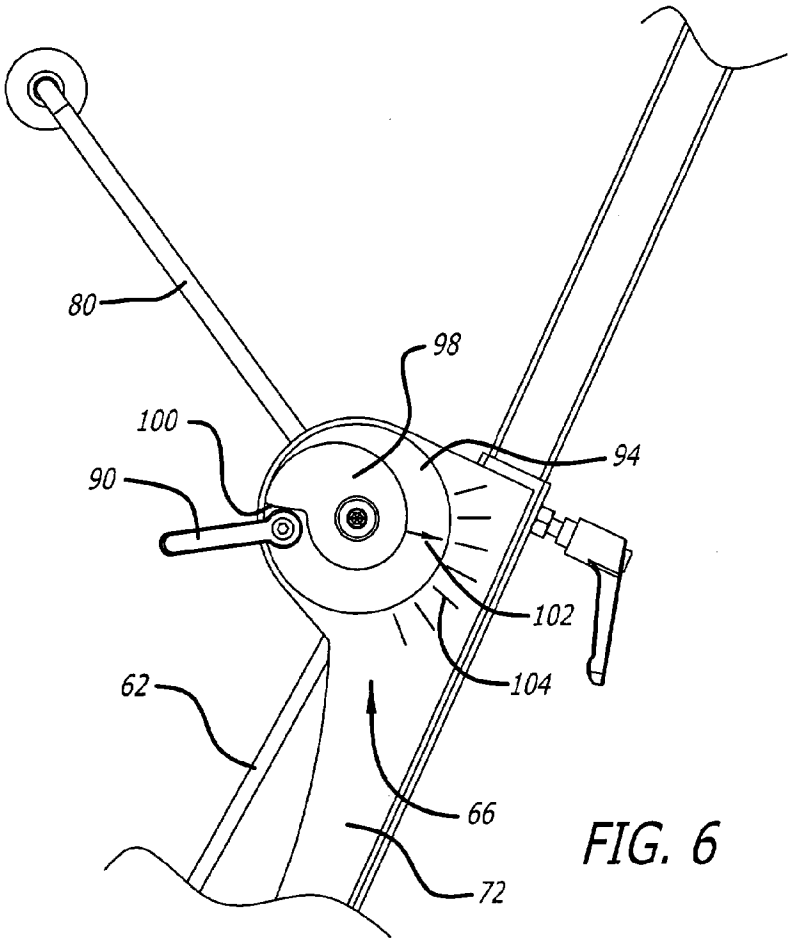
FIG. 6 is a left side elevation view of the control assembly of FIG. 4 with a control handle in the down position, representing the saw blade in a down position.
Figure 5:
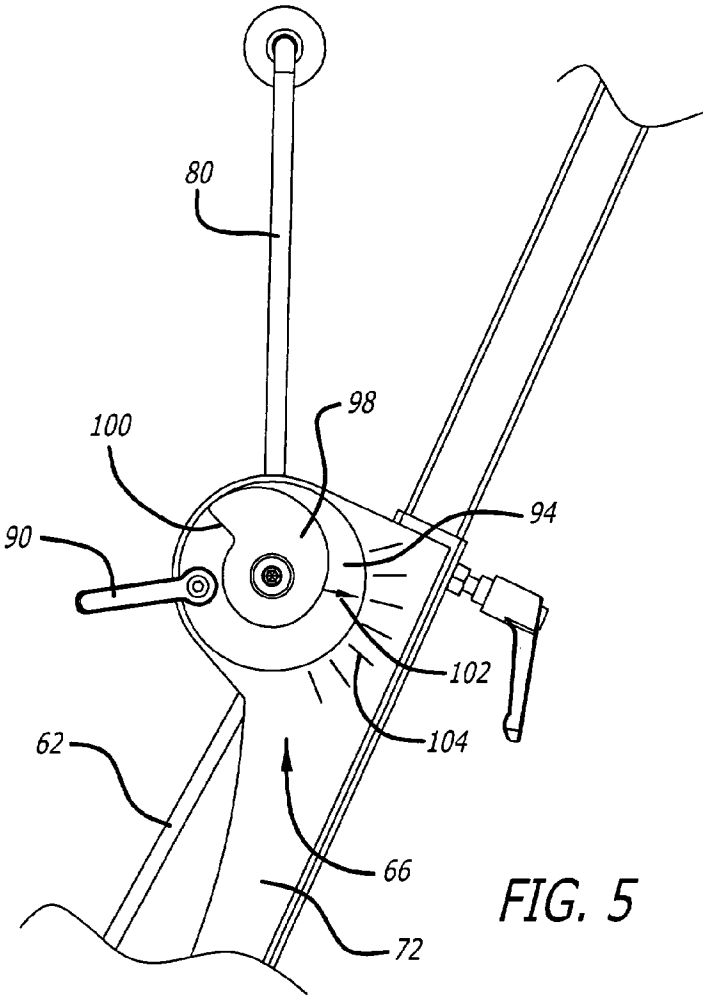
FIG. 5 is a left side elevation of the control assembly of FIG. 4.

A handle 80 is also mounted to a perimeter portion of the transfer disk. The handle 80 permits a user to lower or raise the saw blade. When handle 80 is moved counter clockwise, as viewed in FIG. 2, to its greatest extent, it contacts a stop plate 82, at which point the saw blade would be raised. When the handle 80 is moved clockwise, the saw blade is moved closer to the concrete or deeper into the concrete, until the second frame height control 66 prevents further lowering of the blade. In the illustrated example, the handle 80 is preferably mounted opposite the mounting of the tie rod, but off of the diameter on which the tie rod mount is located (FIG. 4). As shown, the handle 80 is mounted on a circumferential surface of the transfer disk, while the tie rod is mounted to the outside planar surface of the transfer disk.

Figure 3:
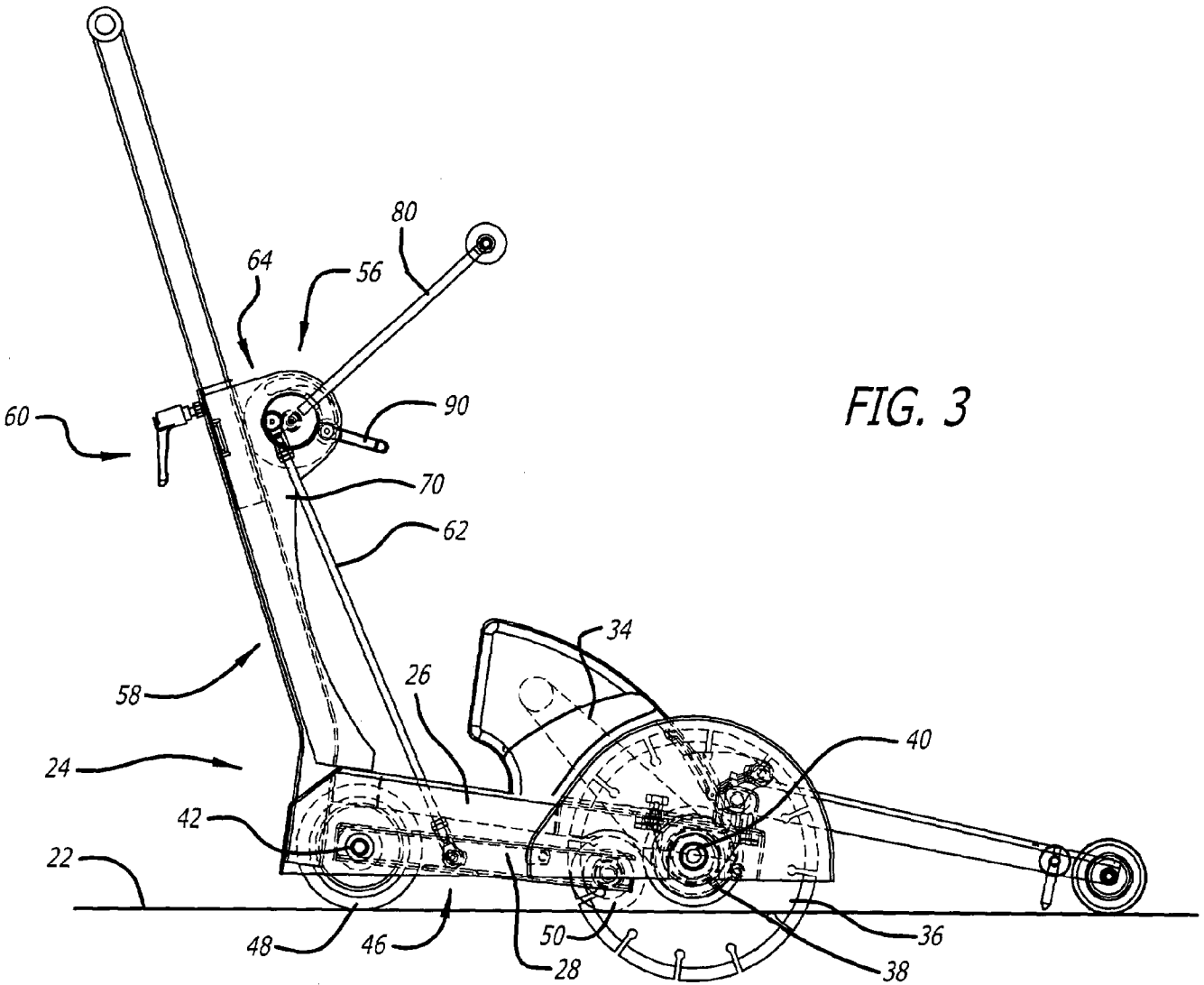
FIG. 3 is a view similar to that of FIG. 2 with the saw blade down.

As shown in FIGS. 2 and 3, the saw blade is raised to its highest point when the handle 80 is moved counter clockwise over center and remains raised when the handle 80 is moved into contact with the stop plate 82. During the counter-clockwise movement of the handle 80, the tie rod has pushed the chassis as far away from the frame as possible. The frame and chassis have their greatest separation at the point where the tie rod is over-center. When the handle 80 is moved clockwise as far as possible, the saw blade is lowered to the lowest point. In that configuration, the tie rod has pulled the chassis as close as possible to the frame, so that the frame moves as far as possible through the arc 44A (FIG. 2) toward the concrete.

Considering the second frame height control 66 in more detail, with respect to the example shown in FIGS. 4-7, the control 66 includes a movable bar, barrier or stop pin 84 that is movable in the same manner as the first frame height control is movable. In the illustrated example, the stop pin is movable in clockwise and counter clockwise directions, as viewed from the direction of FIGS. 5 and 6. Where the first frame height control 64 is movable linearly, the second frame height control preferably is also movable linearly. In the illustrated example, the stop pin is captured in an arc-shaped groove 86 that allows the stop pin to be positioned in any number of locations along the arc. The arc-shaped groove 86 is formed in the left plate 72 with sufficient clearance to allow the stop pin to move freely within the groove when the stop pin is loose. The stop pin 84 includes a friction nut 88 on the internal side of the left plate 72, and the friction nut 88 is mounted to a releasable adjustment lever 90 on a pin 92, which extends through the groove 86 and accepts the nut 88. The adjustment lever 90 is then moved in one direction to tighten down the lever so that the left side plate 72 is captured between the nut 88 and the lever 90, and in another direction to loosen the lever and allow it to move through the groove. The stop pin 84 can be repositioned within the groove, which will limit the forward movement of the handle, as described more fully below, and which will also limit the downward movement of the saw blade. Possible stop pins may be clamps obtained from Heinrich Kipp Werk of Sulz, Germany. Other possible controls may include a trigger ratchet, thumb knobs, and the like.

A friction disk 94 is preferably mounted about the depth control shaft 74 and rotates freely about the shaft. The pin 92 extends through a hole 96 in the friction disk. Movement of the adjustment lever 90 also moves the friction disk relative to the left side plate 72. When the adjustment lever 90 tightens about the left side plate 72, the friction disk bears against the outer surface of the left side plate 72, and frictional engagement between the two of them minimizes the possibility that the lever may move accidentally. The friction disk may be formed from a metal or other strong disk material with a synthetic resin disk material bonded or otherwise attached to that surface of the metal disk facing the left side plate 72. The synthetic disk material may be obtained from various suppliers, including PM Automotive under part No. 930129G. Other substitutes for a friction disk may include knurling.

The second frame height control 66 also includes a depth control stop 98 mounted to the shaft 74 and fixed relative to the shaft so that the depth control stop 98 moves with the transfer plate 76, and therefore with the handle 80. The depth control stop 98 includes a contact surface or stop surface 100 configured to come into contact with stop pin 84 so that further forward movement of the handle 80 is prevented. The stop surface 100 and the position of the stop pin 84 determine the depth of cut, by determining the depth to which the saw blade can extend. In other words, the stop surface 100 and the position of the stop pin 84 determine how close together the frame 24 and the chassis 46 can approach each other as the handle 80 moves forward.

The friction disk 94 may include an arrow 102 or other marking, and the left side plate 72 can include one or more markings 104 calibrated to define the depth of cut. Together, the arrow 102 and markings 104 can be used to reliably set the depth of cut.

Having thus described several exemplary implementations of the invention, it will be apparent that various alterations and modifications can be made without departing from the inventions or the concepts discussed herein. Such operations and modifications, though not expressly described above, are nonetheless intended and implied to be within the spirit and scope of the inventions. Accordingly, the foregoing description is intended to be illustrative only.

What is claimed is:

1. A concrete saw comprising:

a first frame and a motor on the first frame and a saw drive shaft supported relative to the first frame wherein the motor drives the saw drive shaft;

a chassis linked to the first frame in such a way that part of the first frame can move closer to and further from the chassis and including a plurality of wheels for allowing movement of the saw over concrete;

a control assembly supported above the first frame and including a lever pivoting about an axis and a first stop surface configured to pivot with the lever and a second stop surface releasably fixed relative to the frame and movable independent of the lever.

2. The apparatus of claim 1 further including a saw blade driven by the motor.

3. The apparatus of claim 1 wherein the frame further includes a support structure extending upwardly for supporting the control assembly.

4. The apparatus of claim 1 further including a linkage between the chasssis and the first frame and wherein the linkage includes a tie rod.

5. The apparatus of claim 4 wherein the tie rod includes end portions including plastic portions.

6. The apparatus of claim 1 wherein the lever pivots on an axis extending into a portion of the frame.

7. The apparatus of claim 6 wherein the frame includes a support structure extending upwardly from the frame for supporting the control assembly and wherein the lever pivots on an axis through the support structure.

8. The apparatus of claim 6 wherein the lever is configured in such a way that movement of the lever forward relative to the frame and chassis move the frame and chassis closer together.

9. The apparatus of claim 6 wherein the lever is configured in such a way that movement of the lever backward relative to the frame and chassis move the frame and chassis further apart.

10. The apparatus of claim 9 wherein the control assembly includes an over-center mechanism configured to be over-center when the lever has been moved completely backward.

11. The apparatus of claim 1 wherein the control assembly includes a disk.

12. The apparatus of claim 11 wherein the disk is movable with the frame height control.

13. The apparatus of claim 11 wherein the disk is a translation disk that includes a perimeter movable to different positions relative to the frame.

14. The apparatus of claim 13 wherein the translation disk includes a high friction surface movable relative to the frame.

15. The apparatus of claim 13 wherein the translation disk includes a locking element for locking the translation disk relative to the frame.

16. The apparatus of claim 15 wherein the locking element is releasable.

17. The apparatus of claim 13 wherein the translation disk includes an indicator for indicating the relative position of the perimeter of the disk and the frame.

18. The apparatus of claim 1 wherein the control assembly is configured to control the relative position of the first frame and the chassis.

19. The apparatus of claim 1 wherein the control assembly controls a magnitude of the relative position of the first frame and the chassis.

20. The saw of claim 1 wherein the second stop surface is supported by a disk movable independent of the lever.

21. The saw of claim 20 wherein the disk includes a high friction surface.

22. The apparatus of claim 1 wherein the control assembly is configured to control a range of motion of the first frame relative to the chassis.

23. The apparatus of claim 1 further including a clamp for fixing the the second stop surface relative to the first frame.

24. The apparatus of claim 1 wherein the control assembly includes a lock for releasably locking the second stop surface relative to the first frame.

25. The apparatus of claim 1 wherein the lever is supported on a first shaft and wherein the second stop surface is mounted on a support element supported coaxial with the lever.

26. The apparatus of claim 25 wherein the support element is supported by the first shaft.

27. The apparatus of claim 1 wherein the lever is mounted to a pivoting member and further including a coupling between the chassis and the first frame wherein the coupling is also mounted to the pivoting member.

28. The apparatus of claim 27 wherein the coupling includes a rod.

29. The apparatus of claim 28 wherein the rod is a fixed length rod.

30. The apparatus of claim 1 wherein the lever is configured so that the lever can move to an over center configuration.

31. The apparatus of claim 1 wherein the lever and the second stop surface are movable in arcs.

32. The apparatus of claim 1 further including means for indicating a selected depth of cut.

* * * * *